US006567010B1

(12) United States Patent
Lin et al.

(10) Patent No.: US 6,567,010 B1
(45) Date of Patent: May 20, 2003

(54) TRAFFIC SIGNAL HEAD WITH MULTIPLE LED ILLUMINATION SOURCES

(76) Inventors: Fong-Jei Lin, 19450 Via Madronas Ct., Saratoga, CA (US) 95070; Shengbo Zhu, 1072 Minoru Dr., San Jose, CA (US) 95120

( * ) Notice: Subject to any disclaimer, the term of this patent is extended or adjusted under 35 U.S.C. 154(b) by 0 days.

(21) Appl. No.: 09/541,672

(22) Filed: Mar. 31, 2000

(51) Int. Cl.[7] ..... G08B 5/36

(52) U.S. Cl. ..... 340/815.67; 340/815.45; 340/815.65; 340/907; 362/231 R

(58) Field of Search ..... 340/815.67, 815.65, 340/815.45, 907, 908, 925, 931; 362/231 R, 234, 252

(56) References Cited

U.S. PATENT DOCUMENTS

| | | | | |
|---|---|---|---|---|
| 4,780,621 A | * | 10/1988 | Bartleucci et al. | 307/11 |
| 5,136,287 A | * | 8/1992 | Borenstein | 340/925 |
| 5,258,827 A | * | 11/1993 | Cho | 358/21 R |
| 5,420,482 A | * | 5/1995 | Phares | 315/292 |
| 5,663,719 A | * | 9/1997 | Deese et al. | 340/912 |
| 5,898,381 A | * | 4/1999 | Gartner et al. | 340/815.65 |
| 6,058,634 A | * | 5/2000 | McSpiritt | 40/452 |

FOREIGN PATENT DOCUMENTS

JP 08087696 A * 4/1996

OTHER PUBLICATIONS

Encyclopedia of Electronic Circuits (vol. 6) Figs 28/1,2, 1996.*

Encyclopedia of Electronic Circuits (vol. 7) Figs. 31/21–23 and 30, 1999.*

* cited by examiner

*Primary Examiner*—Toan Pham

(57) ABSTRACT

A traffic signal head uses a plurality of LED light sources mounted in one or more containment volumes in a housing. One version uses identical three-color LED light sources distributed through the containment volume: each source having a red light generating element, a yellow light generating element, and a green light generating element. A second version uses identical two-color LED light sources distributed through the containment volume, each source having a red LED light generating element and a green LED light generating element. For the second version, activation circuitry enables individual activation of the red LED elements to produce red signals, individual activation of the green LED elements to produce green signals, and concurrent activation of both types of LED elements to produce yellow signals. Both versions can be electrically configured to display any of the three colors, as well as special symbols-such as directional arrows.

13 Claims, 7 Drawing Sheets

TRAFFIC SIGNAL HEAD WITH MULTIPLE LED ILLUMINATION SOURCES

BACKGROUND OF THE INVENTION

This invention relates to traffic signal control equipment in general, and in particular to an improved traffic signal head.

Traffic signal heads are known and are used to help control the flow of vehicular traffic through a controlled intersection. A conventional signal head has three vertically disposed lamps with colored lenses—one red (usually positioned at an upper position of the signal head), one green (usually positioned at a lower position of the signal head) and one yellow or amber (usually positioned between the red and the green). The state of each lamp is controlled by auxiliary control circuits in accordance with a control algorithm to provide drivers with visual control directives regarding the passage of vehicles through the intersection. Illumination of the red lamp signals the driver to stop at the intersection, while illumination of the green lamp signals the driver t hat passage through the intersection is permitted. Illumination of the yellow or amber lamp signals the driver that the red lamp is about to be illuminated and cautions the driver to be prepared to stop.

Traffic signal heads of the above type have been known and used for decades and have achieved a virtually universal standard status. More recently, variations of the standard three lamp vertical configuration of signal heads have appeared. For example, signal heads have been designed with three lamps arranged in a horizontal row; and with additional lamps of each color to provide greater illumination or noticeability to the driver. All such variations use conventional incandescent lamps as the illumination source.

Even more recently, signal heads have been designed with a different light source. Due to recent improvements in the field of light emitting diode (LED) technology, LEDs have been proposed for use and have actually been implemented in signal heads as the illumination source. Compared to incandescent lamps, LEDs possess some properties which are superior to ordinary lamps. An LED is less fragile than a glass enclosed lamp, and is thus more suited to a signal head application in which the light source is exposed to potential mechanical and environmental damage. Also, an LED has a longer average life time than a conventional incandescent lamp and thus on average requires replacement less frequently. Further, an LED is more light efficient than a conventional incandescent lamp, consuming less electrical power. In addition, an LED can be manufactured to radiate light of a particular color, so that a colored or tinted lens is not required to provide the colors red, green and yellow. For these reasons, LEDs promise to become the illumination source of choice for traffic signal heads in the future.

In known traffic signal heads using LEDs as the illumination source, each single color illumination source is comprised of several monochromatic LEDs clustered together as a unit. This is necessary due to the fact that a single LED does not generate sufficient luminance to function effectively as the illumination source. All LEDs in a given monochromatic cluster are driven in parallel by the appropriate control signal in order to provide the proper visual directives to drivers. Thus, in known signal heads using LEDs, the single incandescent lamp corresponding to a given control color is replaced with a cluster of monochromatic LEDs all operated in parallel or series-parallel, and at least three clusters (one for each control color) are used to replace the at least three incandescent lamps.

U.S. Pat. No. 5,898,381, the disclosure of which is hereby incorporated by reference, discloses an improvement over the basic type of LED based signal head. In this patent, each cluster of monochromatic LEDs is arranged in the shape of a traffic symbol conventionally used with the associated color. For example, the cluster of red LEDs is arranged in an octagonal shape to simulate a conventional stop sign, the cluster of yellow LEDs is arranged in a triangular shape, and the cluster of green LEDs is arranged in a circular shape. In addition, other traffic symbols are represented by clusters of appropriately colored LEDs, such as a green or red arrow. Further, this patent discloses an additional improvement of positioning all signal head LED clusters in a single compartment, with individual LEDs of different colors being mutually interspersed throughout the compartment, so that the bulk and excessive weight of conventional signal heads is substantially reduced without sacrificing the visible functionality of such devices.

While the improvements in the art of signal head technology disclosed in the '381 patent are significant, the need still exists for further improvements in ease of implementation, flexibility of operation, power consumption and cost.

SUMMARY OF THE INVENTION

The invention comprises a signal head which incorporates multiple LED light sources into one or more light source compartments at lowered cost and with lowered power consumption, while still providing visually distinctive multiple color driver advisory signals and symbols.

In a first apparatus aspect, the invention comprises a traffic signal head having a housing and a plurality of LED light sources mounted in the housing for providing red, yellow, and green driver advisory light signals, with each of the LED light sources comprising a first LED light element having a red light generation characteristic and a second LED light element having a green light generation characteristic. The traffic signal head includes activation circuitry for enabling individual activation of the first and second LED light elements and concurrent activation of the first and second LED light elements so that individual activation of the first LED light element produces red light, individual activation of the second LED light element produces green light, and concurrent activation of the first and second LED light elements produces yellow light.

Each of the first and second LED light elements has an anode, a cathode, an anode terminal and a cathode terminal, the cathode terminals of the first and second LED light elements being coupled together to a source of electrical power. The activation circuitry includes first and second power switching devices each having first and second power transfer terminals and a control input terminal. The first power transfer terminal of the first and second power switching devices is coupled to the source of electrical power. The second power transfer terminal of the first power switching device is coupled to the anode terminal of the first LED light element. The second power transfer terminal of the second power switching device is coupled to the anode terminal of the second LED light element. The control input terminal of the first power switching device is coupled to a source of red control signals, the control input terminal of the second power switching device is coupled to a source of green control signals, and the control input terminals of the first and second power switching devices are coupled to a source of yellow control signals. The first and second power switching devices are preferably transistors.

In an alternate embodiment of the invention, each of the LED light sources comprises an encapsulation package containing a first LED light element having a red light generation characteristic, a second LED light element having a yellow light generation characteristic, and a third LED light element having a green light generation characteristic. The traffic signal head includes activation circuitry for enabling individual activation of the first, second, and third LED light elements.

Both embodiments can serve as standard modules in a conventional three compartment signal head, or can be combined in a single compartment to provide a more compact signal head with all three color functions.

From a process standpoint, the invention comprises a method of producing driver advisory signals of different colors, the method comprising the steps of providing a traffic signal head with a plurality of LED light sources each comprising a first LED light element having a red light generation characteristic and a second LED light element having a green light generation characteristic; activating the first LED light element of the plurality of LED light sources to generate red driver advisory signals; activating the second LED light element of the plurality of LED light sources to generate green driver advisory signals; and concurrently activating the first and second LED light elements of the plurality of LED light sources to generate yellow driver advisory signals.

From an alternate process standpoint, the invention comprises a method of producing driver advisory signals of different colors, the method comprising the steps of providing a traffic signal head with a plurality of LED light sources each comprising an encapsulation package containing a first LED light element having a red light generation characteristic, a second LED light element having a yellow light generation characteristic, and a third LED light element having a green light generation characteristic; activating the first LED light element of the plurality of LED light sources to generate red driver advisory signals; activating the second LED light element of the plurality of LED light sources to generate yellow driver advisory signals; and activating the third LED light element of the plurality of LED light sources to generate green driver advisory signals.

The invention provides a traffic signal head which occupies substantially less physical volume than conventional signal heads without sacrificing any operational functionality. In addition, the embodiment of the invention employing only two-color LED light elements requires a substantially reduced number of individual LED light sources, with a commensurate reduction in cost and power consumption, while providing the same driver advisory capability as conventional signal heads. Further, both embodiments of the apparatus can serve as programmable standard modules for a traffic control system, and can be electrically configured to function as red, yellow, or green light generating devices for both the ordinary color advisory signals and special color advisory symbols, such as right or left-pointing red, yellow, or green arrows. Thus, only a single type of standard unit need be inventoried to serve the entire light source requirements of a traffic control system.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
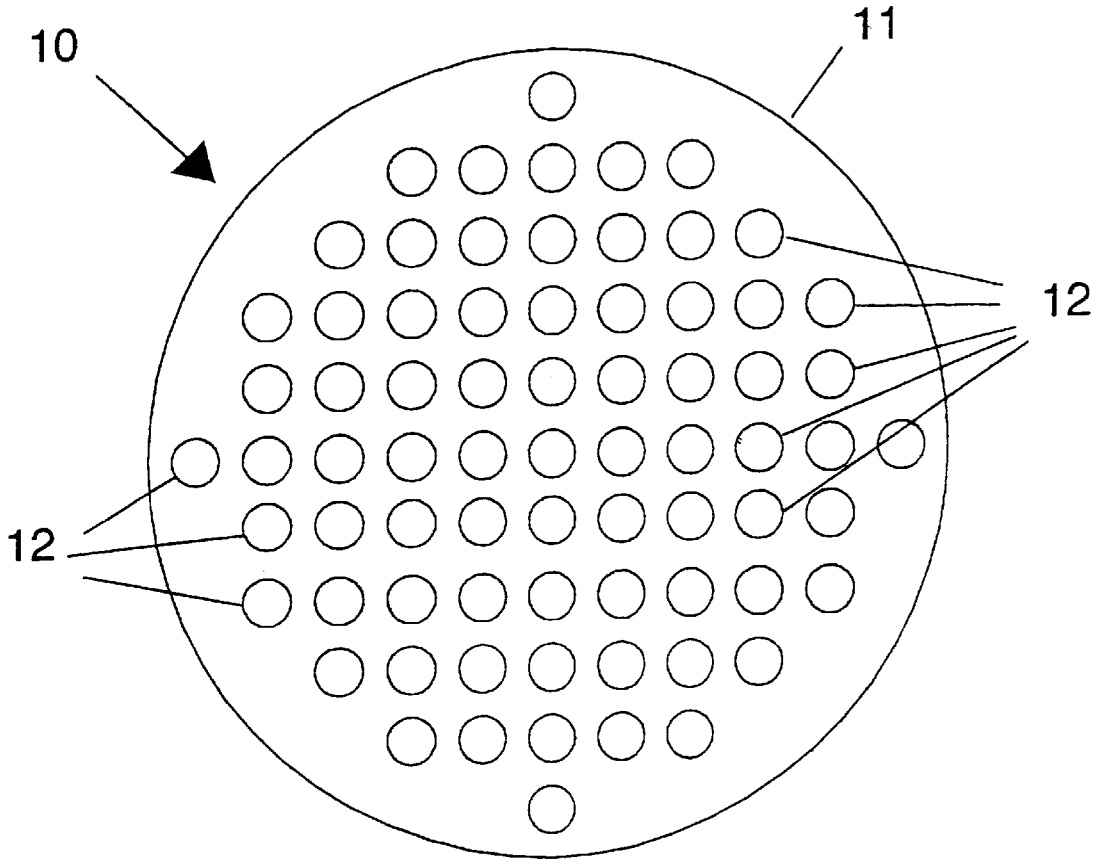
FIG. 1 is a schematic front view of a traffic signal head incorporating the invention.

Turning now to the drawings, FIG. 1 is a schematic front elevational view of a traffic signal head incorporating the invention. As seen in this Fig., a traffic signal head generally designated with reference numeral 10 has a generally circular housing 11 for containing a plurality of individual LED light sources 12. Light sources 12 are arranged in a suitable pattern within the periphery of housing 11 and are preferable mounted in an essentially co-planar manner. Light sources 12 may be one of two different types-a first type consisting of an individual encapsulation package having two LED elements—one red and one green; and a second type consisting of an individual encapsulation package having three LED elements-one red, one yellow, and one green. Preferably, all sources 12 in a given housing 11 are identical.

Figure 2:
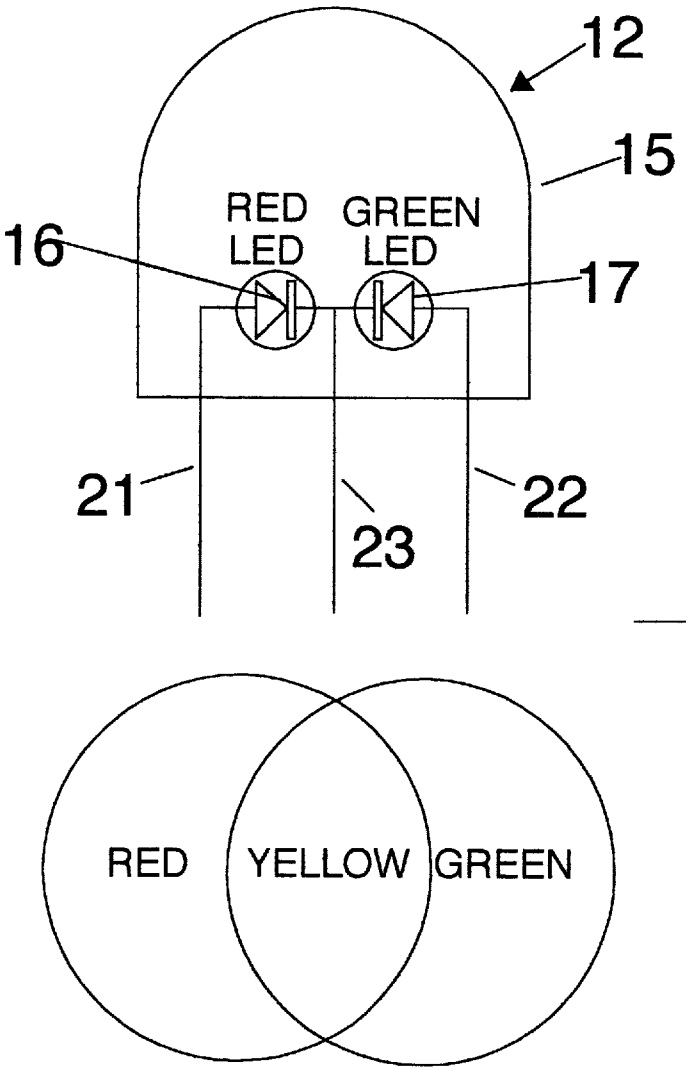
FIG. 2 is a schematic diagram illustrating a first embodiment of the invention using a two color LED basic element for generating all three control colors.

FIG. 2 illustrates the first type of light source 12. As seen in this Fig., an individual source 12 has a conventional light transparent envelope 15 which contains two separate LED elements 16, 17. Element 16 is a red light generating LED, while element 17 is a green light generating LED. The anodes of elements 16, 17 are individually connected to conductive lead-out wires 21, 22, respectively. The cathodes of elements 16, 17 are tied together and connected to common lead-out wire 23. Source 12 is preferably a type SSL-LX 50971GW dual LED device available from Lumex Corp. of Chicago, Ill. As schematically depicted in FIG. 2 in the lower portion thereof, when lead-out wires 21 and 23 are operatively connected to a driving circuit (shown in FIG. 3), only LED 16 is activated and the source 12 generates red light only. When lead-out wires 22 and 23 are operatively connected to a driving circuit, only LED element 17 is activated and the source 12 generates green light only. When all three lead-out wires 21–23 are operatively connected to a driving circuit, both elements 16 and 17 are activated to generate both red and green light. The combination of these two primary colors results in the generation of yellow light by source 12. It is noted that envelope 15 acts as a focussing lens for light generated by LED elements 16, 17, so that the light emanating from source 12 is emitted in a parallel fashion. Consequently, the emitted light as viewed when both LED elements 16, 17 are activated is truly yellow.

Figure 3:
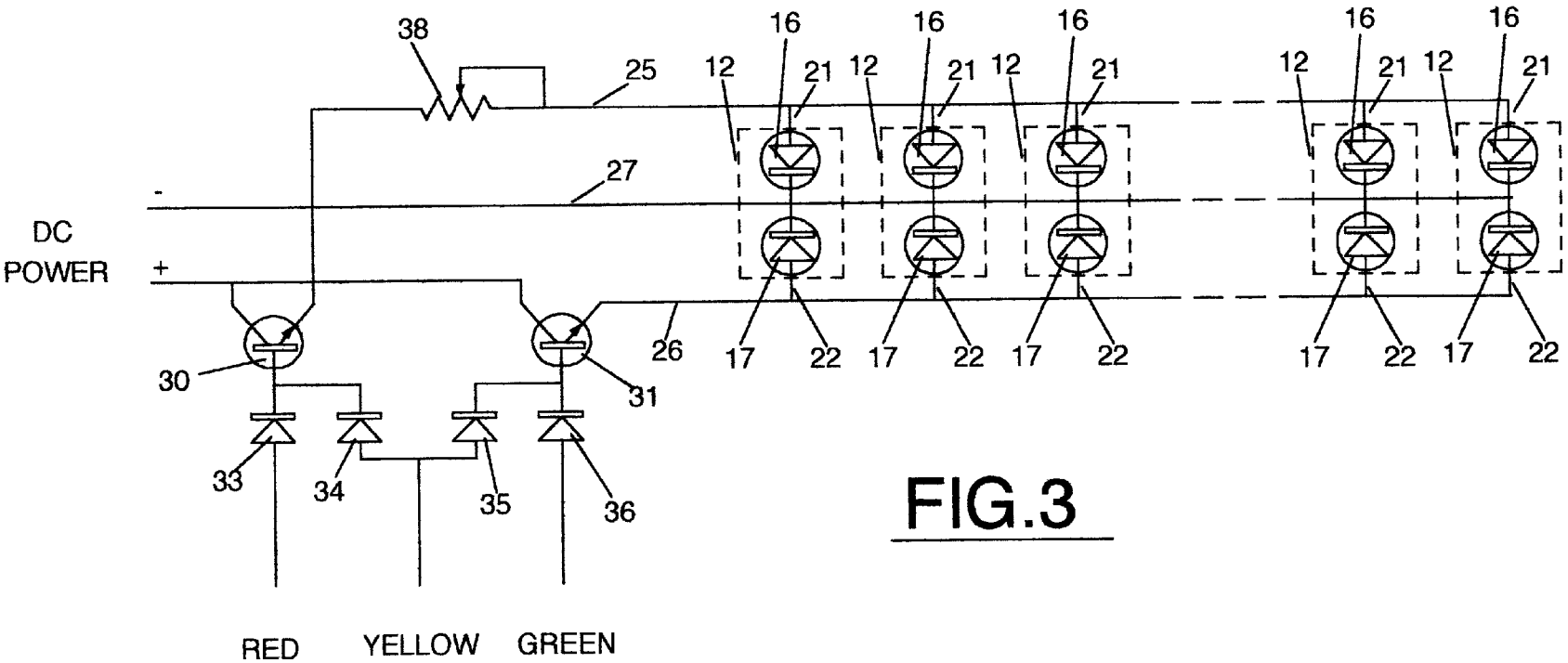
FIG. 3 is a circuit schematic illustrating the driving circuit for the FIG. 2 embodiment.

FIG. 3 illustrates a driving circuit for a signal head using a plurality of LED sources 12 of the first type shown in FIG. 2. As seen in this Fig., a plurality of sources 12 are connected in parallel with the anodes of LED elements 16 connected to a first bus conductor 25, the anodes of LED elements 17 connected to a second bus conductor 26, and the cathodes of both LED elements 16 and 17 connected to a third bus conductor 27. Third bus conductor 27 is coupled to one terminal of a D.C. power source (not shown). First and second bus conductors 25, 26 are individually coupled to the emitter of an associated power control transistor 30, 31, respectively. Conventional traffic control signals termed "RED", "YELLOW", and "GREEN" are coupled via isolation diodes 33–36 to the control electrodes of transistors 30, 31, as shown. When a "RED" control signal is active, transistor 30 is switched on, thereby permitting current to flow through LED elements 16 to cause the generation of red light. When a "GREEN" control signal is active, transistor 31 is switched on, thereby permitting current to flow through LED elements 17 to cause the generation of green light. When a "YELLOW" control signal is active, both transistors 30 and 31 are switched on, thereby permitting current to flow through LED elements 16 and 17 to cause the generation of yellow light.

In order to provide a hue adjustment, a variable resistance 38 is provided in one of the first and second bus conductors 25, 26. By varying the resistance 38, the relative amounts of current flowing through the two main circuit branches can be changed to provide a yellow color of the desired hue. If desired, individual variable resistances may be inserted in series with the individual LED elements 16, 17 to accommodate variations in the intensity of light generated by these elements, although present day LEDs usually do not require such fine tuning.

Figure 4:
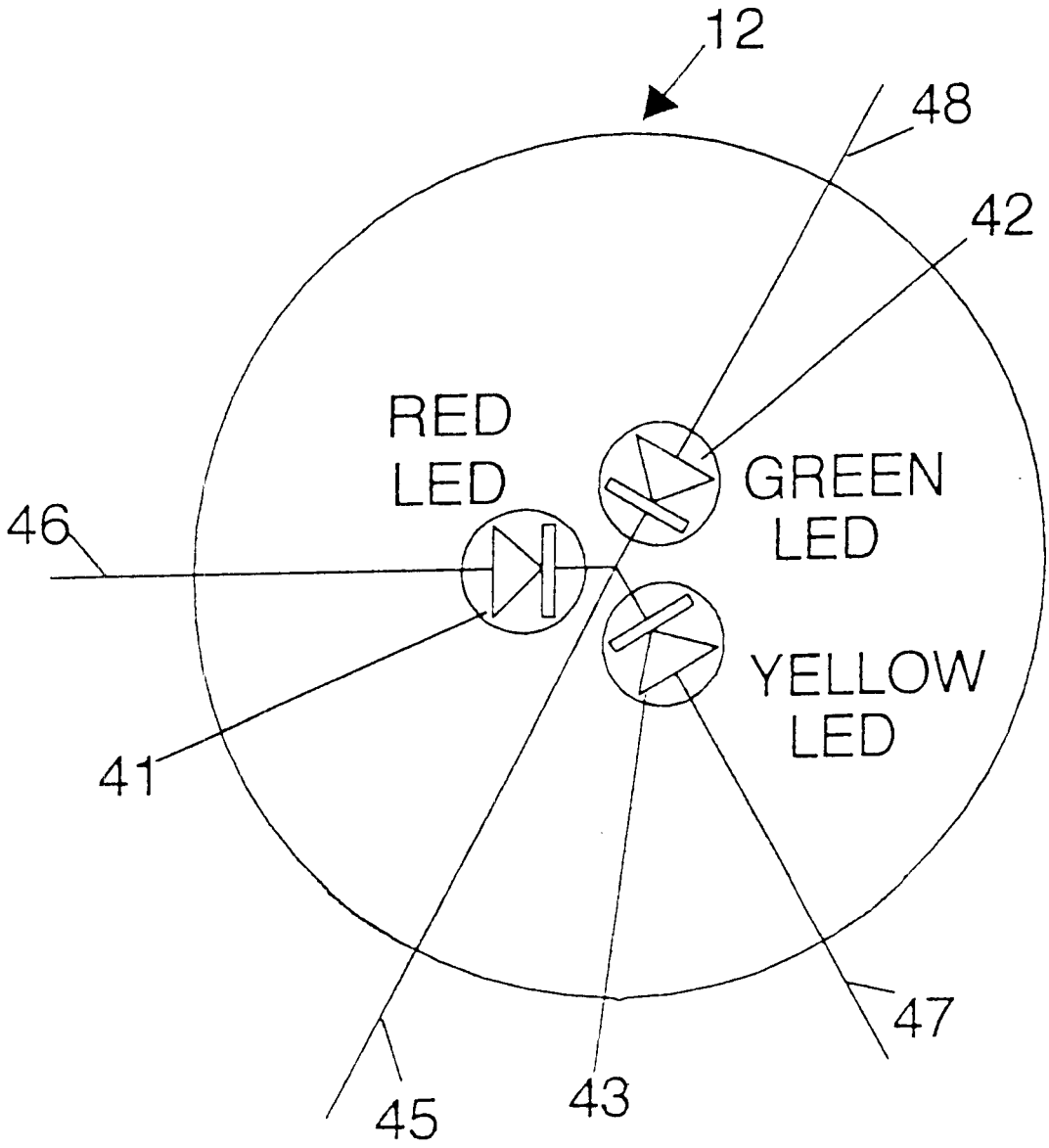
FIG. 4 is a schematic diagram illustrating a second embodiment of the invention using a three color LED basic element for generating all three control colors.

FIG. 4 illustrates an individual light source 12 of the second type. As seen in this Fig., each source 12 includes three separate LED elements in a single encapsulation package: a red light generating LED element 41, a green light generating LED element 42, and a yellow light generating LED 43 element. All three LED elements 41–43 are physically mounted in close mutual proximity so as to simulate a pinpoint source. The cathodes of LED elements 41–43 are coupled together and connected to a common lead-out wire 45, which is coupled to power ground (not illustrated). The anodes of LED elements 41–43 are individually coupled to lead-out wires 46–48 so that power can be applied independently to each of these elements. In a signal head using the FIG. 4 type source, the driving circuit is configured to enable independent operation of groups of red LED elements 41, groups of green LED elements 42, and groups of yellow LED elements 43. The design of such a driving circuit is deemed well within the skill of the ordinary practitioner in the art.

As will now be apparent, signal heads incorporating the invention enjoy a number of advantages over known signal heads. Firstly, in the single signal head compartment application of the invention the size and weight of the overall device are substantially reduced due to the requirement for only one enclosure compartment for all light sources. More specifically, unlike known signal heads which require at least three separate light compartments, signal heads according to the invention may use only one compartment to house the light sources for all three colors. In addition, signal heads employing the first type of light source illustrated in FIG. 2 reduce the number of individual LED light elements required to provide a properly operative signal head, thereby saving space, weight and cost. Further, signal heads utilizing the invention are fully compatible with existing traffic control signal generating equipment, using the same three color control signals which are present in all traffic control systems.

Figure 5:
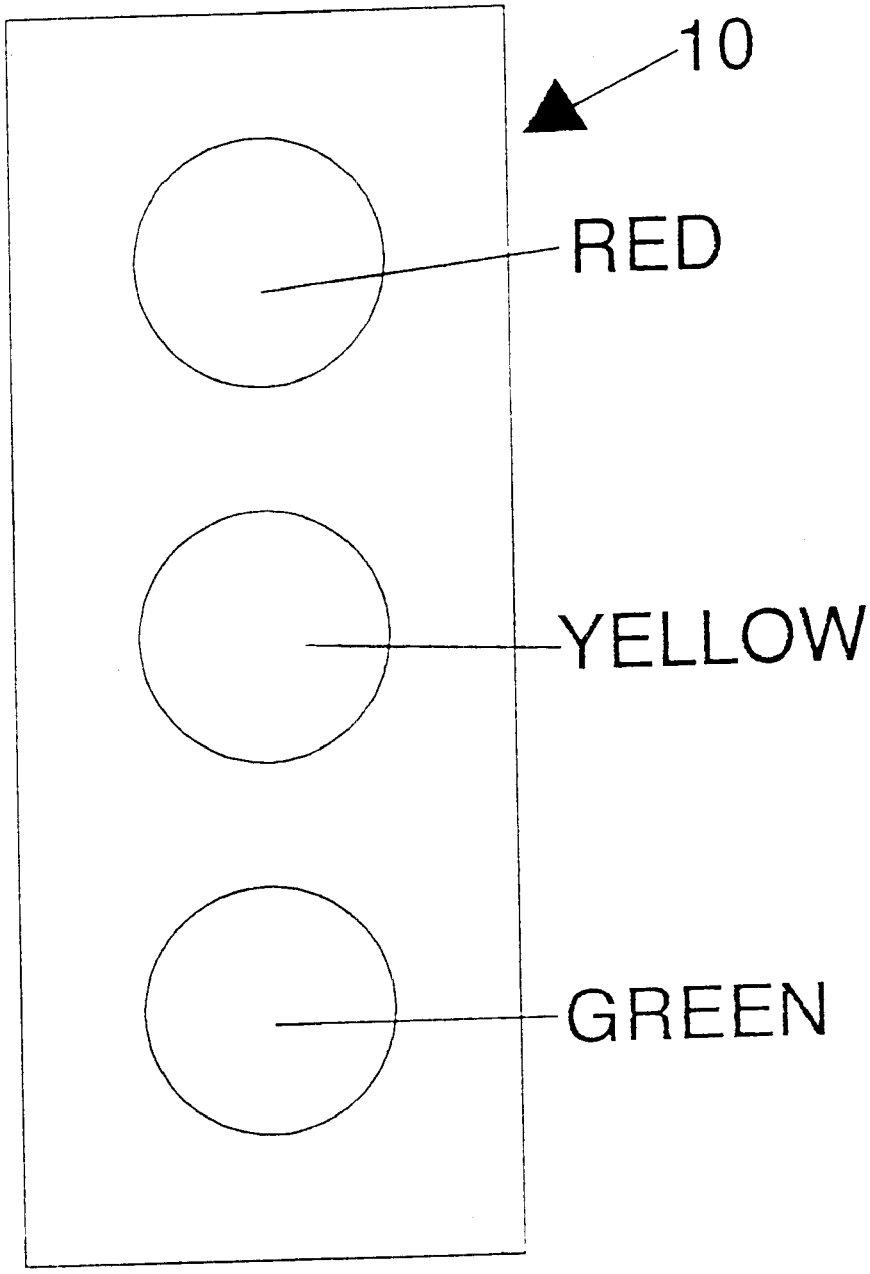
FIG. 5 is a schematic front view of a standard traffic signal head.

Both embodiments of the invention may be designed and used as universal light modules for signal heads. More particularly, as illustrated in FIG. 5 standard signal heads typically have three compartments for. containing the light sources-one for the red source, one for the yellow source, and one for the green source. Either embodiment of the invention can be physically installed in all three compartments of a standard signal head and operated as a dedicated red source, yellow source or green source by simply coupling the modules to the proper color control signal. Thus, for example, the LED elements of both types of light source can be electrically connected to provide red color signals alone, yellow color signals alone, or green color signals alone. The advantage of this application of the invention resides in the fact that only one single module need be inventoried for all the light source needs of a traffic control installation.

Figure 6:
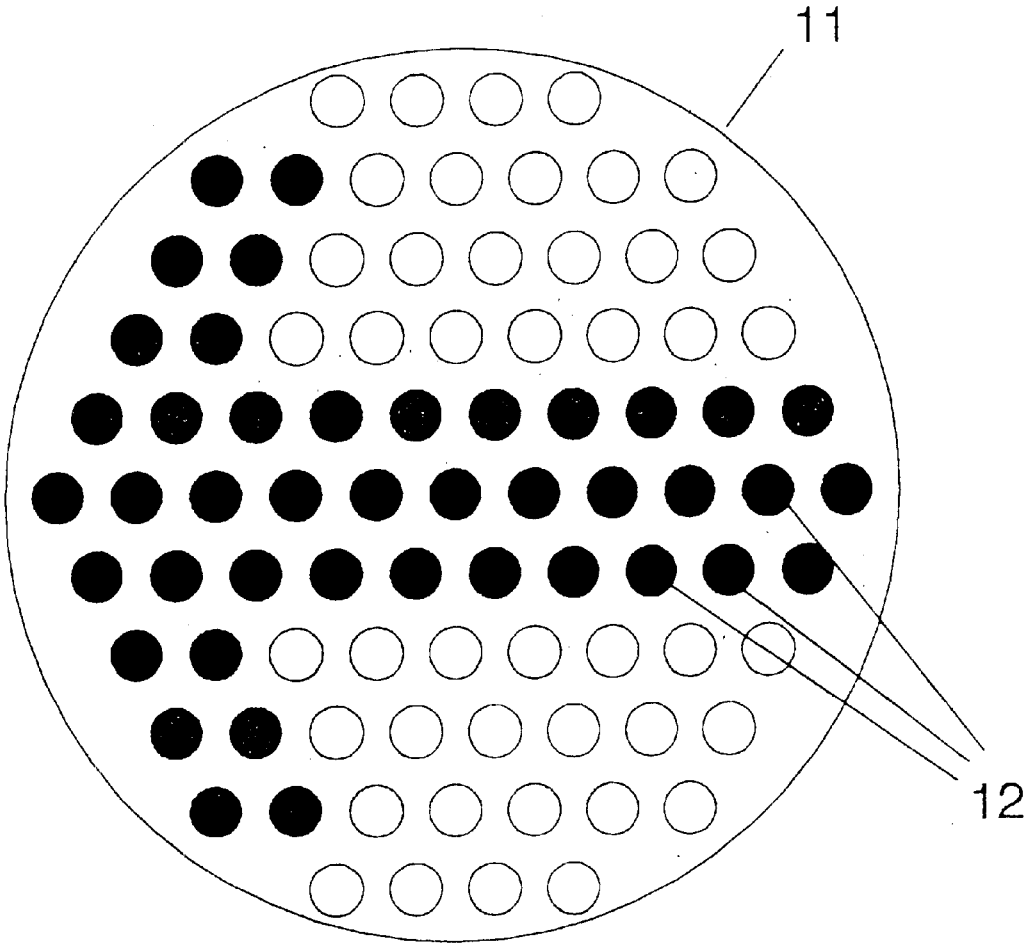
FIG. 6 is a schematic diagram illustrating one configuration of the invention for displaying traffic advisory symbols.

The invention can also be configured to provide directional visual advisory signals, such as left or right turn arrows of any desired color or straight through arrows. FIG. 6 illustrates a left turn arrow configuration.

Figure 7:
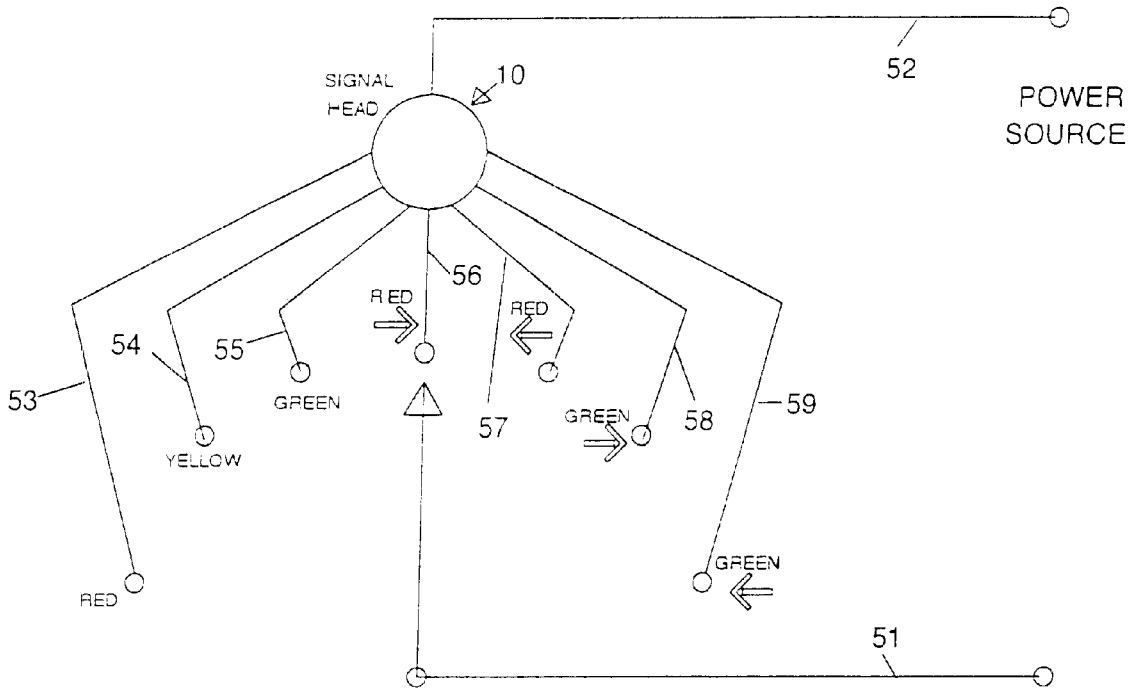
FIG. 7 is a circuit diagram illustrating the driving circuit for the FIG. 6 configuration.

As seen in this Fig., a group of individual light sources 12 is geometrically arranged as a left-pointing arrow. To illuminate the arrow, the individual LED light elements of the desired color in each individual source package are simply activated using the electrical control signal provided by the traffic control system. In addition, arrowed signals of two or three colors can be generated so that the left turn lane can exhibit red, yellow, and green arrows, if desired. FIG. 7 illustrates one variation having a bi-directional red arrow and a bi-directional green arrow. As seen in this Fig., a signal head 10 is coupled to a power source by means of power conductors 51, 52. Red, yellow, and green. color control signals are supplied to signal head 10 via control signal conductors 53–55. Color arrow control signals are supplied to signal head 10 via control signal conductors 56–59. To activate a right-pointing red arrow advisory signal, a control signal is applied to conductor 56. To activate a left-pointing red arrow advisory signal, a control signal is applied to conductor 57. To activate a right-pointing green arrow advisory signal, a control signal is applied to conductor 58. To activate a left-pointing green arrow advisory signal, a control signal is applied to conductor 59. As will be apparent to those of ordinary skill in the art, the arrangement of FIG. 7 may be expanded to include yellow arrow advisory signals, and may be contracted to provide single headed arrows, arrows of only one color, and the like.

Another modification to the arrow head module of FIG. 6 is as follows. Any of the modules can be configured to display directional arrows or other informative symbols by hard. wiring together the anodes of individual ones of the light sources 12, and providing a dedicated lead out wire for receiving a control signal for activating the grouped sources. A standard module can thus incorporate several display functions, and the system user can select those functions which are appropriate for a given module installation by simply providing a suitable control signal to the control terminals for the functions to be activated and ignoring the rest of the built-in functions. Thus, light sources according to the invention are user programmable.

Although the above provides a full and complete disclosure of the preferred embodiments of the invention, various modifications, alternate constructions and equivalents will occur to those skilled in the art. For example, other geometrical configurations than the circular shape described above may be employed, as desired. Further, many symbols and legends may be implemented by installing an opaque mask with appropriate translucent areas in front of a module. In addition, modules may be fabricated using integrated circuit processing technology to provide a plurality of individual light sources distributed throughout the viewable area of the module, with each light source having the two-color or three-color light elements with cathodes coupled in common and individually connectible anodes. In such an embodiment, the individual encapsulation packages can be replaced with a single transparent or translucent cover having lens regions located over the individual light sources. Therefore, the above should not be construed as limiting the invention, which is defined by the appended claims.

What is claimed is:

1. A traffic signal head comprising:

a housing;

a light source module mounted in said housing, said module having a plurality of LED light sources for providing red, yellow, and green driver advisory light signals, each of said plurality of light sources comprising a first LED light element having a red light generation characteristic and a second LED light element having a green light generation characteristic;

D.C. power activation circuitry for enabling individual D.C. power activation of said first and second LED light elements and concurrent D.C. power activation of said first and second LED light elements so that individual D.C. power activation of said first LED light element produoes red light, individual D.C. power activation of said second LED light element produces green light, and concurrent D.C. power activation of said first and second LED light elements produces yellow light; and circuitry for enabling adjustment of the relative intensity of light produced by said first and second LED light elements in order to provide yellow light of proper hue.

2. The invention of claim 1 wherein all of said LED light sources are located in a single containment volume in said housing.

3. The invention of claim 1 wherein each of said first and second LED light elements has an anode, a cathode, an anode terminal and a cathode terminal, the cathode terminals of said first and second LED light elements being coupled together to a source of D.C. electrical power; and wherein said activation circuitry includes first and second D.C. power switching devices each having first and second power transfer terminals and a control input terminal, the first power transfer terminal of said first and second power-switching devices being coupled to said source of D.C. electrical power, the second power transfer terminal of said first power switching device being coupled to the anode terminal of said first LED light element, the second power transfer terminal of said second power switching device being coupled to the anode terminal of said second LED light element, the control input terminal of said first power switching device being coupled to a source of red control signals, the control input terminal of said second power switching device being coupled to a source of green control signals, and the control input terminals of said first and second power switching devices being coupled to a source of yellow control signals.

4. The invention of claim 3 wherein said first and second power switching devices are transistors.

5. The invention of claim 1 wherein some of said plurality of light sources are electrically grouped together for concurrent D.C. power activation to provide a visible display of at least one preselected symbol.

6. The invention of claim 5 wherein said at least one preselected symbol is an arrow.

7. A method of producing driver advisory signals of different colors, said method comprising the steps of:

providing a traffic signal head with a plurality of LED light sources each having a first LED light element having a red light generation characteristic and a second LED light element having a green light generation characteristic;

activating the first LED light element of said plurality of LED light sources with D.C. power to generate red driver advisory signals;

activating the second LED light elements of said plurality of LED light sources with D.C. power to generate green driver advisory signals; and concurrently activating the first and second LED light elements of said plurality of LED light sources with D.C. power to generate yellow driver advisory signals, said step of concurrently, activating including the step of maintaining the relative intensity of light produced by said first and second LED light elements in such a manner as to provide yellow light of proper hue.

8. For use in a traffic signal head to provide driver advisory signals of different colors, a light source module having a a plurality of LED light sources, said plurality of LED light sources each comprising a first LED light element having a red light generation characteristic and a second LED light element having a green light generation characteristic, activation circuitry for enabling individual D.C. power activation of said first and second LED light elements and concurrent D.C. power activation of said first and second LED light elements so that individual activation of said first LED light element produces red light, individual activation of said second LED light element produces green light, and concurrent activation of said first and second LED light elements produces yellow light; and means for enabling adjustment of the rely intensity of light produced by said first and second LED light elements in order to provide yellow light of proper hue.

9. The invention of claim 8 wherein some of said plurality of light sources are electrically grouped together for concurrent D.C. power activation to provide a visible display of at least one preselected symbol.

10. The invention of claim 9 wherein said at least one preselected symbol is an arrow.

11. For use in a traffic signal head, a programmable light source module having a plurality of LED light sources distributed throughout a viewing area for selectively displaying within said viewing area at least one of a plurality of traffic advisory light symbols in at least two different colors, each of said plurality of LED light sources comprising a first LED light element having a red light generation characteristic and a second LED light element having a green light generation characteristic and activation circuitry for enabling selective D.C. power activation of said first and second LED light elements so that said at least one of said plurality of traffic advisory light symbols can selectively be displayed within said viewing area in two alternate colors; wherein said activation circuitry enables individual D.C. power activation of said first and second LED light elements and concurrent D.C. power activation of said first and second LED light elements so that individual D.C. power activation of said first LED light element produces red light, individual D.C. power activation of said second LED light element produces green light, and concurrent D.C. power activation of said first and second LED light elements produces yellow light; and wherein said activation circuitry further includes means for enabling adjustment of the relative intensity of light produced by said first and second LED light elements in order to provide yellow light of proper hue.

12. The invention of claim 11 wherein each of said plurality of LED light sources indudes a third LED light element having a light generation characteristic of a third color; and wherein said activation circuitry includes circuitry for enabling selective D.C. power activation of said first, second, and third LED light elements so that said at least one of said plurality of traffic advisory light symbols can be displayed in three different colors.

13. The invention of claim 11 wherein said at least one of said plurality of traffic advisory light symbols is an arrow.

* * * * *